United States Patent [19]

Anderson et al.

[11] Patent Number: 4,470,764

[45] Date of Patent: Sep. 11, 1984

[54] DEMAND RESPONSIVE HYDRAULIC PUMP

[75] Inventors: Stanley E. Anderson, Saginaw; Leonard N. Franklin, Jr., Reese, both of Mich.

[73] Assignee: General Motors Corporation, Detroit, Mich.

[21] Appl. No.: 473,661

[22] Filed: Mar. 9, 1983

[51] Int. Cl.[3] ..... F04B 49/08; F04B 49/02

[52] U.S. Cl. ..... 417/299; 417/310

[58] Field of Search ..... 417/283, 284, 299, 310

[56] References Cited

U.S. PATENT DOCUMENTS 2,193,244 3/1940 Wolcott ..... 417/299

2,362,724 11/1944 Shea ..... 417/299 X

*Primary Examiner*—Richard E. Gluck

*Attorney, Agent, or Firm*—Donald F. Scherer

[57] ABSTRACT

A hydraulic power steering system has a vane type pump which is operable to supply fluid to a power steering gear at a volumetric rate determined in part by the system pressure or system demand. The pump flow is partially bypassed through a valve member which is slidably disposed in the thrust plate of the pump. The thrust plate has a bypass aperture which communicates between the pump discharge and the pump inlet. The valve member is spring loaded to permit fluid communication through the apertures and is pressure biased by increasing system pressure to reduce the bypass flow and thereby increase system discharge flow.

2 Claims, 1 Drawing Figure

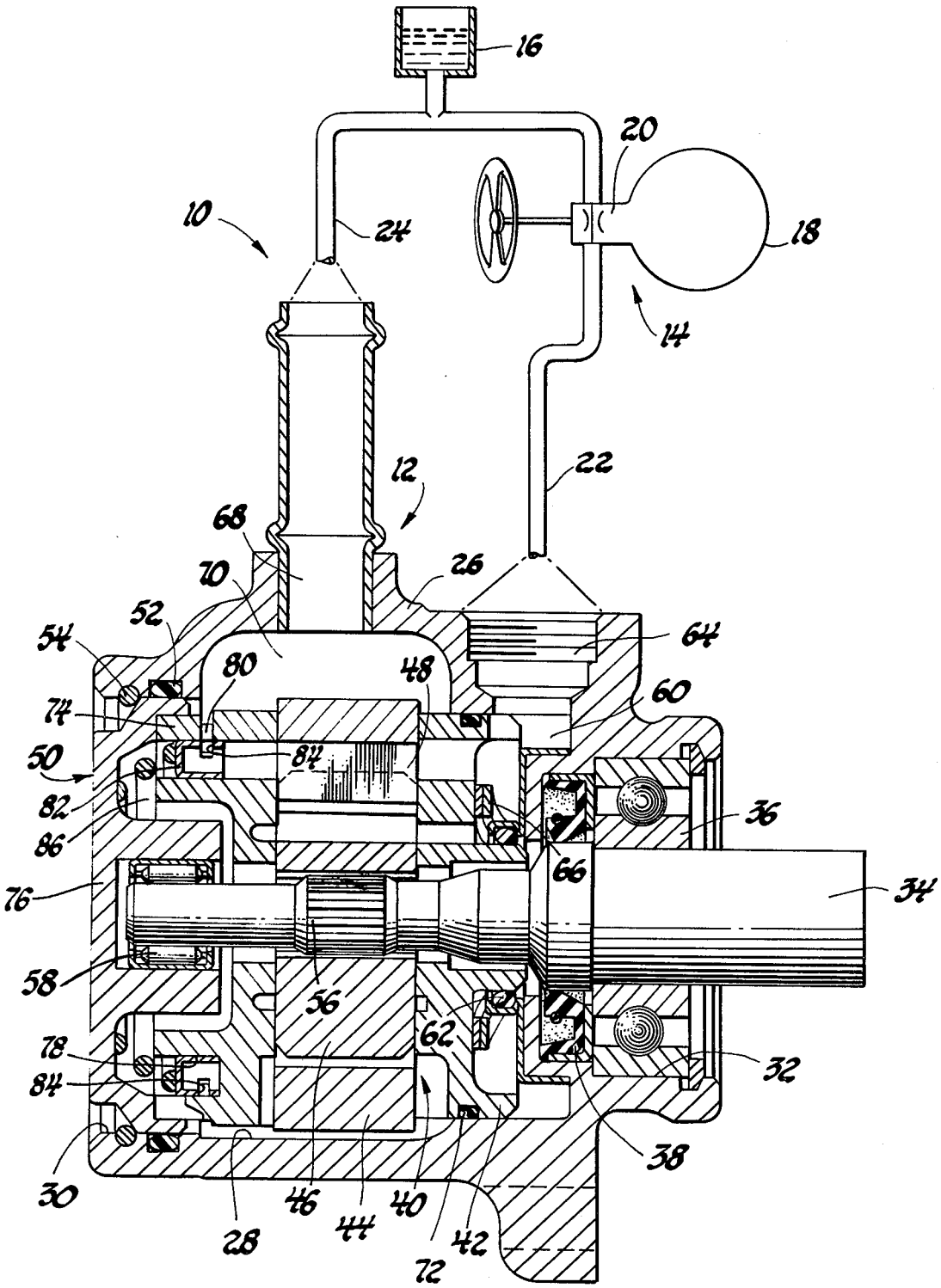
16
20
10
24
18
14
12
22
68
70
26
52
54
64
80
48
60
74
50
84
82
86
36
66
76
34
58
56
62
78
84
32
38
30
46
44
40
28
42
72

DEMAND RESPONSIVE HYDRAULIC PUMP

This invention relates to vane type hydraulic pumps and more particularly to such pumps having an integral bypass control valve.

When a vehicle is equipped with a power steering system, the hydraulic pump is a parasitic loss within the system whenever a turning maneuver is not occurring. Many efforts have been made to reduce these losses. These efforts have generally resulted in the use of flow controlled type pumps which limit the fluid volume delivered to the steering gear thereby limiting the back pressure within the system.

The present invention seeks to reduce the losses by reducing the flow to the steering gear whenever a steering demand is not present. When a steering demand becomes present, the system will discharge the fluid required to satisfy the demand with the remaining fluid being bypassed. This differs from a flow controlled system in that the flow to the steering gear is continually limited regardless of demand.

It is therefore an object of this invention to provide an improved hydraulic pump for use in a power steering system wherein the pump includes a thrust plate in which is slidably disposed a spring biased bypass valve which cooperates with a bypass passage to directly connect the pump discharge with the pump inlet at low discharge pressures and wherein the valve is pressure biased to close the bypass passage incrementally as system pressure increases.

It is another object of this invention to provide an improved hydraulic vane type pump for use in a power steering system wherein the vane pumping chambers have the discharge thereof communicating directly with the inlet through bypass apertures disposed in the pump thrust plate and wherein the bypass apertures are controlled by a spring loaded valve member which is operable to reduce the opening of the bypass apertures upon increasing system pressure such that increased pump discharge flow will occur.

These and other objects and advantages of the present invention will be more apparent from the following description and drawing which is a cross-sectional elevational view of a vane type pump which is connected in a diagrammatic representation of a power steering system.

The power steering system 10 includes a vane type hydraulic pump, generally designated 12, a steering gear assembly, generally designated 14, and a fluid reservoir 16. The steering gear assembly 14 includes a power-assisted steering gear 18 and a steering valve 20. The steering gear assembly 14 may be constructed in accordance with the steering gear assembly shown in U.S. Pat. No. 3,022,772, issued Feb. 27, 1962, to Zeigler, and assigned to the assignee of this application.

The vane type pump 12 is connected through a pump discharge passage 22 to the steering valve 20 such that pressurized fluid from the pump 12 is delivered to the steering gear assembly 14. The steering valve 20 and reservoir 16 are both connected to the pump 12 through a pump return or inlet passage 24.

The vane type pump 12 includes a pump housing 26 having an internal housing cavity 28 with a large opening 30 at one end thereof and a smaller opening 32 at the other end thereof. A drive shaft 34 extends through the smaller opening 32 and is rotatably supported in a shaft bearing 36 which is secured in the opening 32 and is contacted by a shaft seal 38 also secured in the opening 32. The shaft seal 38 functions to prevent atmospheric air from entering the pump and low pressure fluid leakage from the pump.

The housing cavity 28 is substantially filled with a vane pump assembly, generally designated 40, and including a pressure plate 42, a cam ring 44, a rotor 46, a plurality of vanes 48 and an end cover and thrust plate 50. The end cover and thrust plate 50 cooperates with an annular seal ring 52 and a locking ring 54 to close the large opening 30.

The rotor 46 includes a plurality of slots in which the vanes 48 are slidably disposed in a well-known manner. The vanes 48 contact the inner surface of cam ring 44 so as to provide a plurality of peripheral pumping chambers which expand and contract upon the rotation of rotor 46 when it is driven through a spline connection 56 by the drive shaft 34.

The end cover and thrust plate 50 and pressure plate 42 establish the axial limits of the peripheral pump chambers and also includes pump inlet and discharge porting arrangements disposed in a well-known manner. The end cover and thrust plate 50 supports a shaft bearing 58 in which is rotatably supported the left end of drive shaft 34.

The discharge from the pumping chambers of the vane pump assembly 40 passes through pressure plate 42 to a discharge space 60 formed between the right end of cavity 28 and the left end surface of pressure plate 42. Leakage to the drive shaft 34 from the discharge space 60 is prevented by an annular seal ring 62. The discharge space 60 is in fluid communication with a pump discharge port 64 which in turn is in fluid communication with the pump discharge passage 22.

To ensure that the vane pump assembly 40 is urged into abutment with the locking ring 54, an assist spring 66 disposed in the discharge space 60 is provided. Thus, even at atmospheric pressure within the discharge space 60 there is a leftward force provided which continually urges the pump vane assembly toward the locking ring 54.

The pump inlet passage 24 is connected with a pump inlet port 68 which in turn communicates with an inlet space 70 which surrounds the cam ring 44 in the housing cavity 28. The inlet space 70 communicates fluid from the return passage 24 to the inlet portion of the vane pump assembly 40. The inlet space 70 is sealed from direct communication with the discharge space 60 by an annular seal ring 72 disposed in the pressure plate 42.

The end cover and thrust plate 50 is a two-piece assembly and includes a thrust plate 74 and an end cover 76. The end cover 76 cooperates with the seal ring 52 to prevent external leakage. The thrust plate 74 includes a pocket 78 which communicates with the pumping chambers, formed by the vanes 48, at the discharge portion of the pump cycle. Communicating with the pocket 78 is a plurality of bypass apertures or passages 80 which distribute fluid to the inlet space 70.

An annular bypass valve 82 is slidably disposed in the pocket 78. The bypass valve 82 has a plurality of circumferentially extending control slots 84 which, in the position shown, are aligned with the bypass passages 80. The bypass valve 82 is urged toward the position shown by a valve spring 86 disposed between the bypass valve 82 and the end cover 76.

The control slots 84 and bypass passages 80 permit a predetermined amount of the pump discharge to pass directly to the pump inlet when the steering requirement of steering gear assembly 14 is low or nonexistent. The fluid discharged from the pumping chambers of vane pump 40 which does not bypass directly to the inlet is delivered via pump discharge passage 22 through the steering gear assembly 14. When a steering maneuver is undertaken, the resistance to the fluid flow in discharge passage 22 increases resulting in an increase in pressure in pocket 78. The fluid pressure in pocket 78 will operate on the right side of bypass valve 82 urging it leftward against the valve spring 86.

At a predetermined pressure, the valve 82 will move leftward thereby reducing the opening of bypass passages 80 which will result in a reduction of the amount of fluid bypassed and correspondingly an increase in the amount of fluid discharged to the steering gear assembly 14.

When the demand pressure is sufficient, the bypass passages 80 will be completely closed by the bypass valve 82. A further demand for a pressure increase will result in reopening of the bypass passages 80 at the right end of valve 82 thus establishing a pressure relief value for the power steering system.

The embodiments of the invention in which an exclusive property or privilege is claimed are defined as follows:

1. A demand responsive power steering pump comprising; inlet means for receiving fluid; outlet means for directing fluid from the pump and the fluid being subjected to various outlet pressure levels; vane pump means including rotor, vane and cam means for providing a plurality of pump chambers and a pair of end plate means for closing the axial ends of said chambers; one of said end plate means including valve means for bypassing some fluid from said pump chambers directly to said inlet means when the outlet pressure level is below a predetermined amount and for progressively decreasing the bypass flow as the outlet pressure level increases; said valve means comprising an annular chamber, annular valve means disposed in said chamber, passage means communicating one side of said annular valve means with said inlet means for permitting said bypassing of fluid, spring means urging said annular valve means to open said passage means and outlet fluid pressure acting on said annular valve means in opposition to said spring means to move said annular valve means to close said passage means.

2. A demand responsive power steering pump comprising; inlet means for receiving fluid; outlet means for directing fluid from the pump and the fluid being subjected to various outlet pressure levels; vane pump means including rotor, vane and cam means for providing a plurality of pump chambers and a pair of end plate means for closing the axial ends of said chambers; one of said end plate means including valve means for bypassing some fluid from said pump chambers directly to said inlet means when the outlet pressure level is below a predetermined amount and for progressively decreasing the bypass flow as the outlet pressure level increases; said valve means comprising an annular chamber, annular valve means disposed in said annular chamber, slot means in said annular valve means and apertures in said one end plate aligned with said slot means for permitting said bypassing of fluid, spring means urging said annular valve means to open said slot means, and outlet fluid pressure acting on said annular valve means in opposition to said spring means to move said annular valve means to close said apertures.

* * * * *